US007232314B2

(12) United States Patent
Abe

(10) Patent No.: US 7,232,314 B2
(45) Date of Patent: Jun. 19, 2007

(54) END STRUCTURE OF COAXIAL CABLE

(75) Inventor: Kazuji Abe, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/245,073

(22) Filed: Oct. 7, 2005

(65) Prior Publication Data

US 2007/0010133 A1 Jan. 11, 2007

(30) Foreign Application Priority Data

Jul. 7, 2005 (JP) ..... 2005-198653

(51) Int. Cl.
*H01R 12/00* (2006.01)

(52) U.S. Cl. ..... 439/63

(58) Field of Classification Search ..... 439/63, 439/581; 174/75 C, 88 C
See application file for complete search history.

(56) References Cited

U.S. PATENT DOCUMENTS 3,141,718 A * 7/1964 Schott et al. ..... 439/466
3,141,924 A * 7/1964 Forney, Jr. ..... 174/75 C
3,179,912 A * 4/1965 Huber et al. ..... 439/581
3,980,382 A * 9/1976 Reeder ..... 439/581

FOREIGN PATENT DOCUMENTS

JP 63-317784 A 12/1988
JP 2002-203618 A 7/2002

* cited by examiner

*Primary Examiner*—Phuong Dinh
(74) *Attorney, Agent, or Firm*—Arent Fox LLP

(57) ABSTRACT

A coaxial cable comprises a dielectric for covering a core wire, a conductor layer disposed around the dielectric, a housing disposed around the conductor layer. The housing and conductor layer at the processed end part of this coaxial cable is removed, a prescribed length of an exposed dielectric is removed from the end and the core wire inside is connected to the electrode of a circuit substrate. In this case, a shielding material is disposed in the vicinity of the dielectric in such a way as to cover the exposed dielectric, and this shielding material is connected to a common electrode formed on a substrate.

12 Claims, 20 Drawing Sheets

VCC : POWER SUPPLY
SG : SIGNAL GROUND
FG : FRAME GROUND
Rt : RESISTOR

} GENERALLY CALLED: GROUND

END STRUCTURE OF COAXIAL CABLE

BACKGROUND OF THE INVENTION

1. Field of the Invention

The present invention relates to the structure of the end of a coaxial cable used to transmit RF signals.

2. Description of the Related Art

In RF signal transmission, in an interface circuit, for example, as shown in FIG. 1, the circuit substrate 101 on the driver side (for example, the computer on the server side) and the circuit substrate 102 on the receiver side (for example; a number of personal computers) are connected to a coaxial cable 105 via connectors 103 and 104. In this case, on the transmission route including the circuit substrate 101 on the driver side and the coaxial cable 105, it is ideal that the output impedance of the circuit device 106 on the driver side, the impedance of the pattern part 107 of the circuit substrate, the impedance of a connector 103, the impedance of the coaxial cable 105, the impedance of the processed end part 108 and the like all are the same. This also applies to the receiver side.

This is because if the impedances of such parts differ, a transmission signal is reflected at a part where two impedances are not matched causing its waveform to be distorted etc. Therefore, it is necessary to match impedances, especially in RF signal transmission (for example, the transmission of a signal of 1 GHz or more).

However, FIG. 2 discloses prior art in which the fluctuations of the characteristic impedance of the processed end part of a coaxial cable 117 are suppressed and the impedance is matched with the characteristic impedance of the circuit substrate. In this coaxial cable 117, an inner conductor 112 projected from the tip of an insulator 111 constitutes a signal terminal, and an outer conductor 115 is connected to a grounding terminal 113 via a drain line 116. The grounding terminal 113 is exposed at the end part 114*a* of an incorporated and molded cover material. Furthermore, the grounding terminal 113 and a circuit substrate, which is not shown in FIG. 2, are connected by pressing the grounding terminal 113 against the grounding electrode of the circuit substrate (for example, see Patent reference 1).

Another prior art reference, FIG. 3 discloses a coaxial cable 121 used for a semiconductor device inspection device. This semiconductor device inspection device comprises a probe core wire 122 at the tip of the coaxial cable 121, for touching the electrode of a semiconductor device, which is not shown in FIG. 3, and transmitting/receiving an inspection signal, and an insulating tube 123 through which the probe core wire 122 is inserted and can be moved. The probe core wire 122 is covered by an insulator 124 and its circumference is covered with an outer conductor (shielding material) 125. Between the outer conductor 125 and insulating tube 123, there is a fixed substrate 126 and a conductor 127. Furthermore, the semiconductor device inspection device comprises a spring for pressing this coaxial cable 121 in such a way that the probe core wire 122 can touch the electrode of the semiconductor, which is not shown in FIG. 3 (for example, see Patent reference 2).

Patent reference 1: Japanese Patent No. 2002-203618

Patent reference 2: Japanese Patent No. S63-317784

However in the technology set forth in Patent reference 1, since the exposed insulator 111 of the processed end part is not shielded by an outer conductor 115, the characteristic impedance of the coaxial cable 117 increases and varies. Because the characteristic impedance (Z) of a coaxial cable generally depends on the inductance (L) and the capacitance (C) per unit length of the cable ($Z \cong \sqrt{L/C}$), a prescribed characteristic impedance value cannot be obtained if the insulator 111 of the processed end part is not shielded by the outer conductor 115.

In the technology set forth in Patent reference 2, since the specific structure of the processed end part is not clear and the exposed insulator 124 is not shielded although the insulating tube 123 and outer conductor 125 are grounded when pressing the insulating tube 123 to the grounding electrode of the circuit substrate, the impedance cannot be improved.

SUMMARY OF THE INVENTION

The present invention aims to solve such a problem, and it is an object of the present invention to provide the end structure of a coaxial cable capable of matching the impedance of the coaxial cable at low cost, by shielding the exposed conductor at the end of the coaxial cable.

According to the present invention, when exposing the core wire by removing the outer housing and conductor layer at the end of a coaxial cable and removing the exposed conductor layer from the end to a prescribed length, and connecting the core wire, for example, to a circuit substrate, the exposed conductor is covered with a shielding material and the shielding material is grounded. Therefore, the coaxial cable becomes electrically equivalent to that in which a conductor layer is formed around the exposed conductor. Thus, the shielding effect at the end of a coaxial cable can be improved to reduce its impedance and suppress its impedance fluctuations.

According to the present invention, when exposing the core wire by removing the outer housing and conductor layer at the end of the coaxial cable and removing the exposed conductor from the end to a prescribed length, and connecting the core wire, for example, to a circuit substrate, the exposed conductor is covered with a shielding material and the shielding material is grounded. Therefore, the shielding effect at the end of the coaxial cable can be improved with a simple structure to match its impedance.

DESCRIPTION OF THE PREFERRED EMBODIMENTS

The preferred embodiments of the present invention are described below with reference to the drawings.

Figure 1:
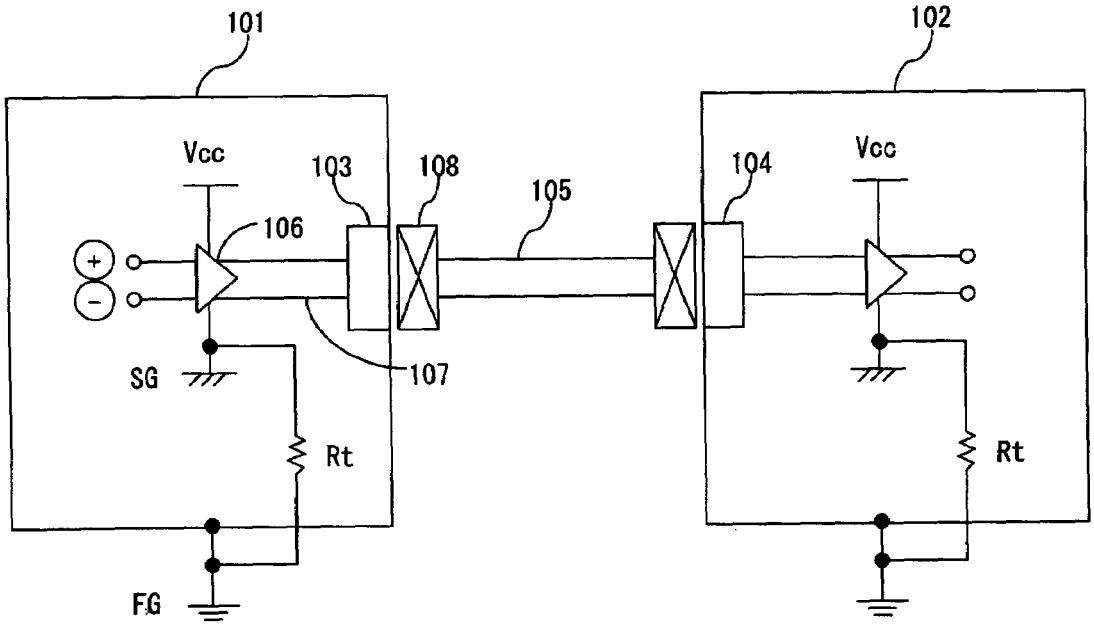
FIG. 1 shows an interface circuit.
Figure 2:
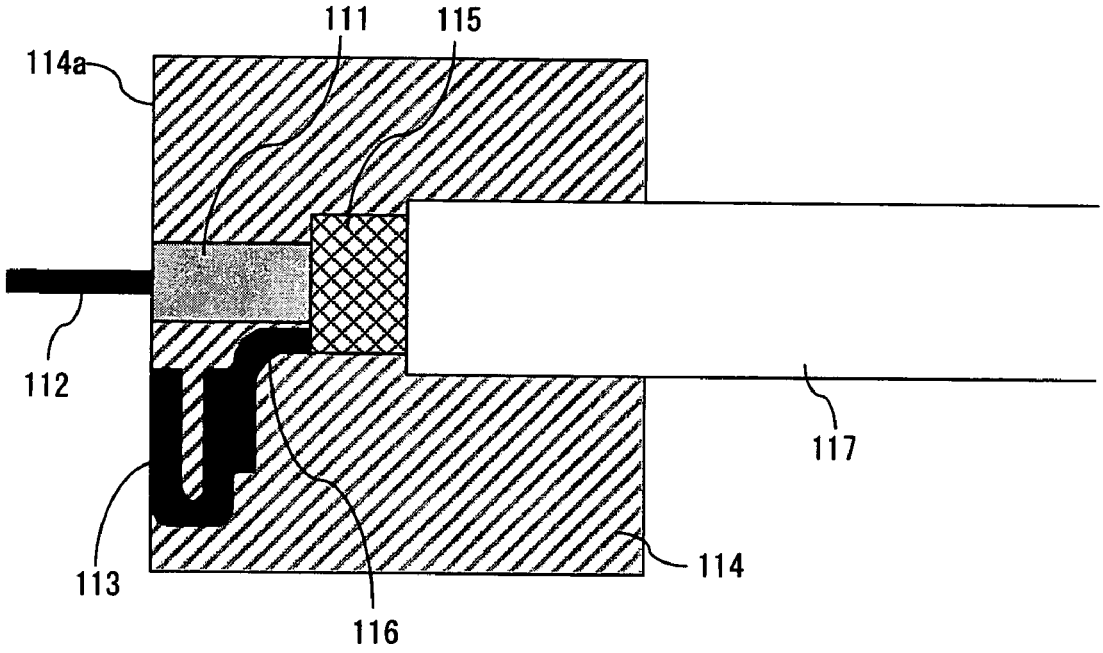
FIG. 2 shows the conventional coaxial cable for substrate connection.
Figure 3:
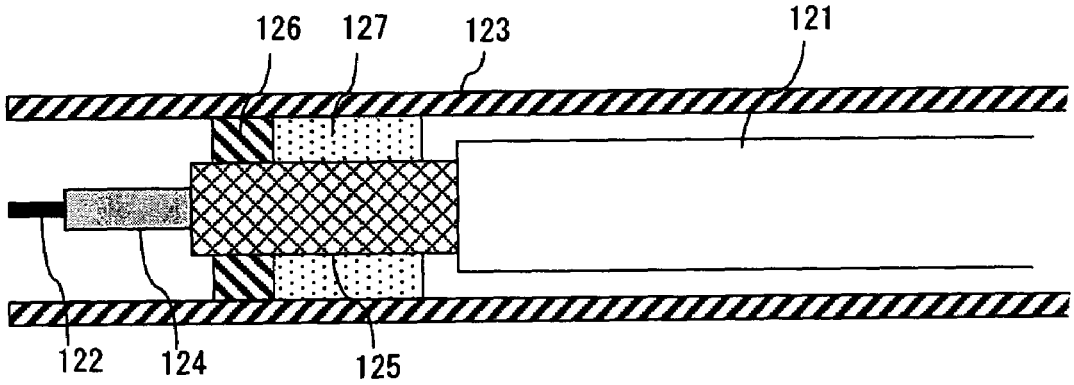
FIG. 3 shows a coaxial cable used for a conventional semiconductor device inspection device.
Figure 4:
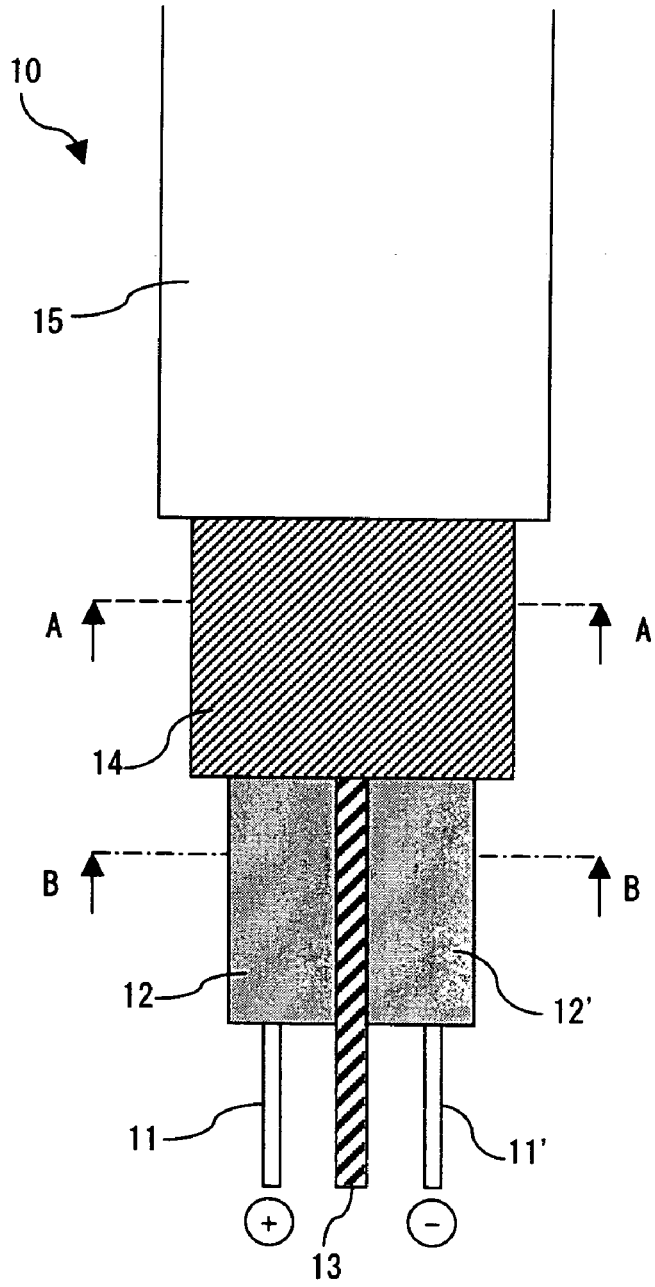
FIG. 4 shows the structure of the processed end of the coaxial cable used of the preferred embodiment.
Figure 5:
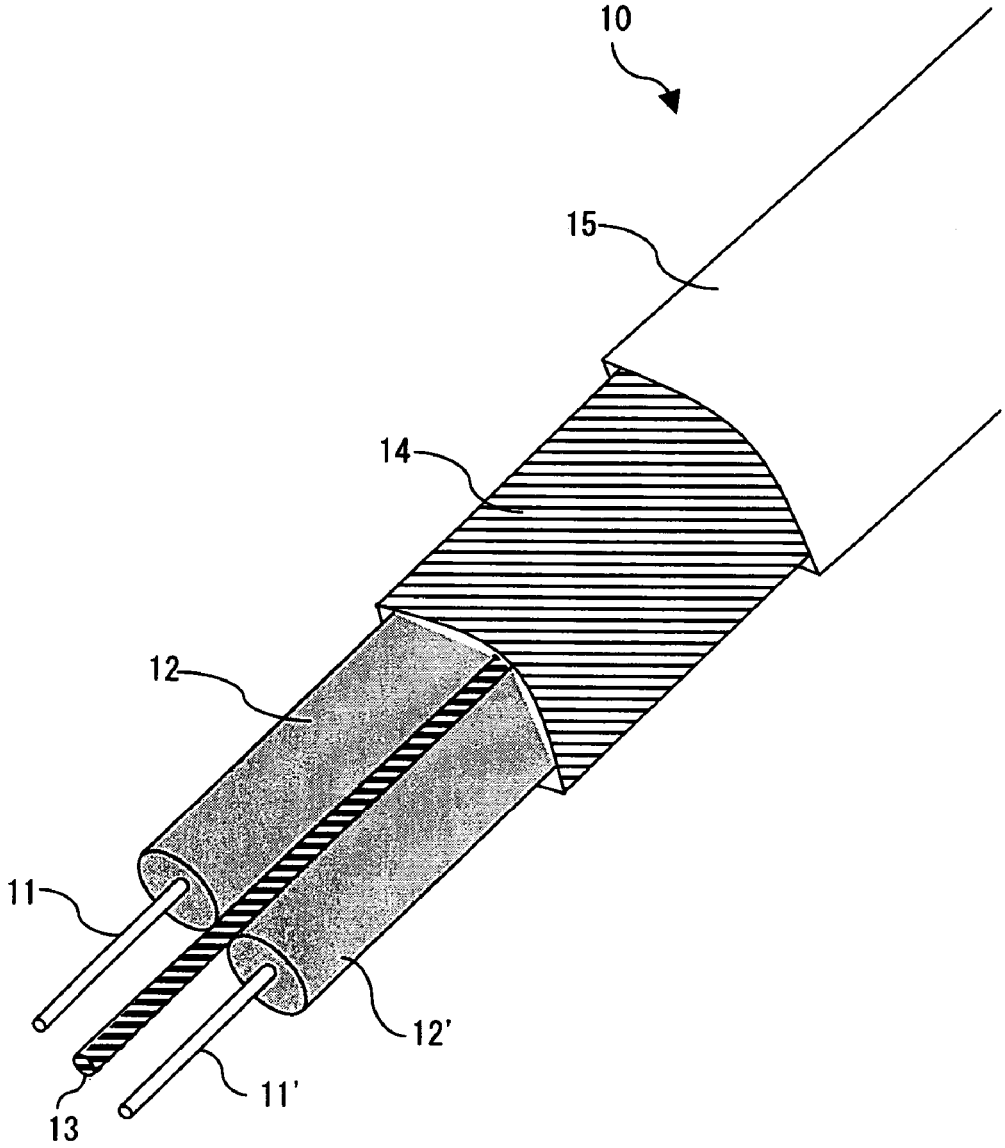
FIG. 5 is its appearance in perspective view.
Figure 6:
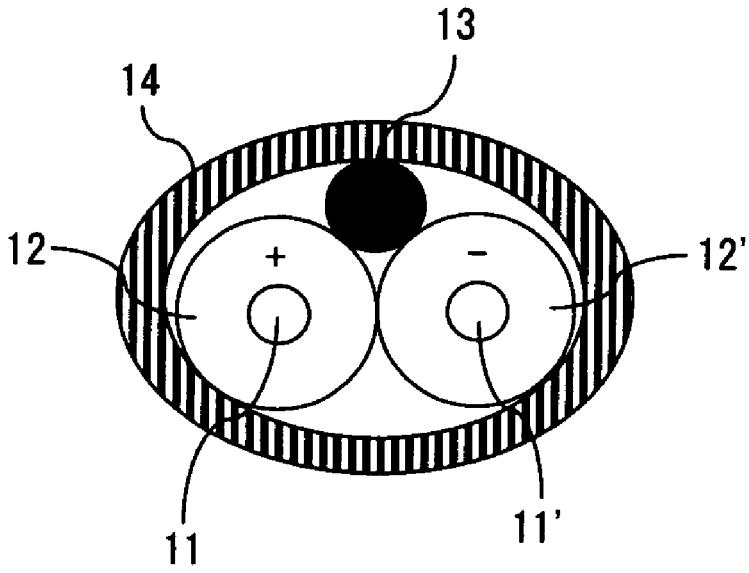
FIG. 6 is the A—A section view of FIG. 4.
Figure 7:
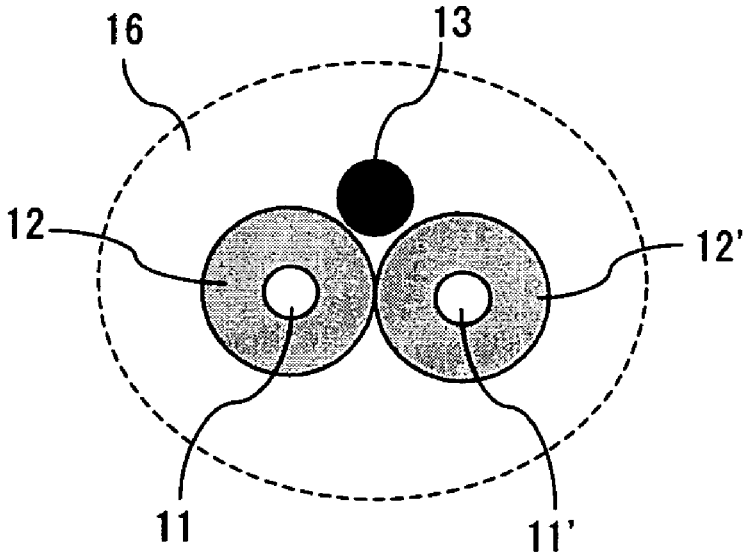
FIG. 7 is the B—B section view of FIG. 4.

FIG. 4 shows the structure of the processed end of the coaxial cable used in this preferred embodiment. FIGS. 5, 6 and 7 are the appearance in perspective view, the A—A section view and the B—B section view, respectively, of FIG. 4. Although in this preferred embodiment, a two-core coaxial cable is described as an example, the description also applies to a single or multiple-core coaxial cable.

In FIGS. 4 and 5, in a coaxial cable 10, a shielding conductor layer 14 is provided around dielectrics (polyethylene, etc.) 12 and 12' enclosing conductor core wires (copper, etc.) 11(+) and 11(−) around a drain line (ground line) 13, and an outer housing (poly vinyl chloride, etc.) 15 is provided around the conductor layer 14. The conductor layer 14 is formed by, for example, an aluminum foil net, not shown in FIGS. 4 and 5, and as a result is difficult to solder. Therefore, the drain line (for example, a copper wire) 13 is electrically connected to the conductor layer 14, embracing it. In the coaxial cable 10, noise is shielded from external fields by the conductor layer 14 to make it suited to transmitting RF signals.

At the end of the coaxial cable 10, for example, the outer housing 15 is removed, a prescribed length of the conductor layer 14 is removed from the cable end, and the dielectrics 12 and 12' are processed and exposed. The conductor core wires 11 and 11' are exposed by pulling out the drain line 13 from between the dielectrics 12 and 12' and the conductor layer 14 and removing a short length of the dielectric 12 from the cable end.

As shown in FIG. 6, the coaxial cable 10 is manufactured in such a way that in a part where the conductor layer 14 is provided around the dielectrics 12 and 12', the impedance between the conductor core wires 11 and 11' may assume the characteristic impedance value peculiar to the coaxial cable 10. However, as shown in FIG. 7, in the part where the shielding conductor layer 14 around the dielectrics 12 and 12' is removed, the circumference of the dielectrics 12 and 12' are surrounded by air 16, and thus the capacitance (air) decreases. Therefore, in this part, the impedance between conductor core wires 11 and 11' increases according to the above-described equation for impedance (Z), $Z \cong \sqrt{L/C}$.

For this reason the impedance at the end of the coaxial cable 10 increases. In the following description, the same reference numerals are attached to the same or equivalent components as described above.

In this preferred embodiment, the impedance at the end can also be prevented from increasing by shortening the length (extra length) of the conductor core wires 11 and 11' at the end and the length of the exposed part of the dielectrics 12 and 12', of a coaxial cable. However, in this case, there is a fear that short circuit will occur due to poor insulation strength, insulation resistance or the like between the conductor core wires 11 and 11'. If the length of the conductor core wires 11 and 11' at the end and the length of the exposed part of the dielectrics 12 and 12' are too short, work becomes difficult and manufacturing cost increases when pre-processing the coaxial cable 10. Furthermore, when connecting the coaxial cable 10 to a substrate, it becomes difficult to solder the conductor core wires 11 and 11' to the substrate.

(The First Preferred Embodiment)

Figure 8:
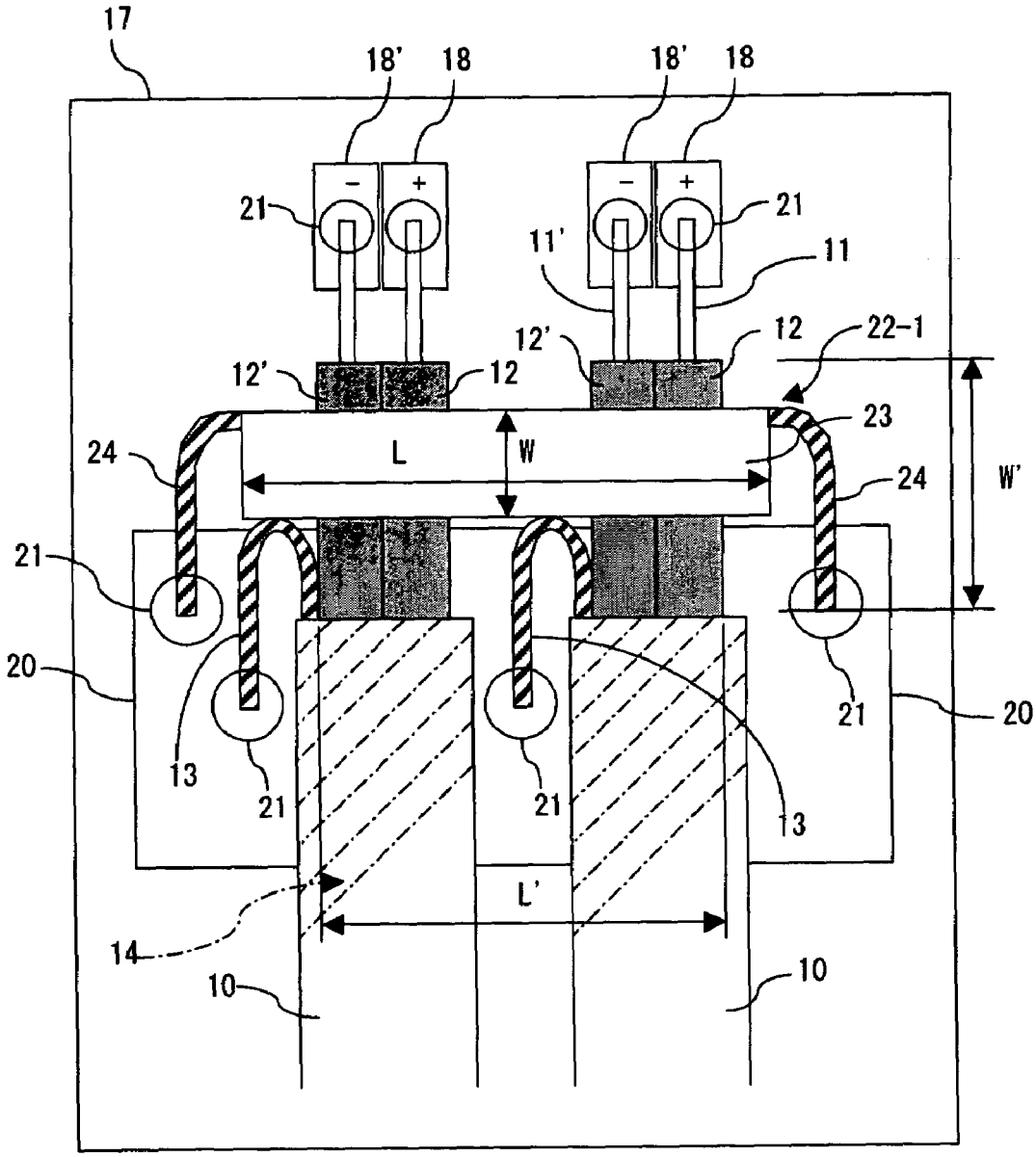
FIG. 8 shows the structure of the end of the coaxial cable of the first preferred embodiment.

FIG. 8 shows the end structure of the coaxial cable 10 of the first preferred embodiment.

In FIG. 8, in the coaxial cable 10, the respective tips of the conductor core wires 11 and 11' exposed from the dielectrics 12 and 12' are soldered (21) to the electrodes 18 and 18' of a substrate 17. The drain line 13 pulled out from between the dielectrics 12 and 12' and the conductor layer 14 is soldered (21) to a common grounding electrode (hereinafter called "common electrode") 20 formed on the substrate.

In this preferred embodiment, a shielding material 22-1 disposed in the vicinity of the dielectrics 12 and 12' is provided in such a way as to cover the dielectrics 12 and 12' exposed at the end of the coaxial cable 10, and this shielding material 22-1 is connected to the common electrode 20 formed on the substrate 17.

Specifically, the shielding material 22-1 comprises a conductive tape 23 as a first conductor foil and a soft conductor wire 24 as a conductor wire. Then, the exposed dielectrics 12 and 12' are covered with the conductive tape 23, on the reverse side of the substrate 17, so as to be embraced. Furthermore, each free end of the soft conductor wires 24 extended from each side of the conductive tape 23 is soldered (21) to each common electrode 20 of the substrate 17.

FIGS. 9A–D show the detailed structure of the shielding material 22-1.

Figure 9A:
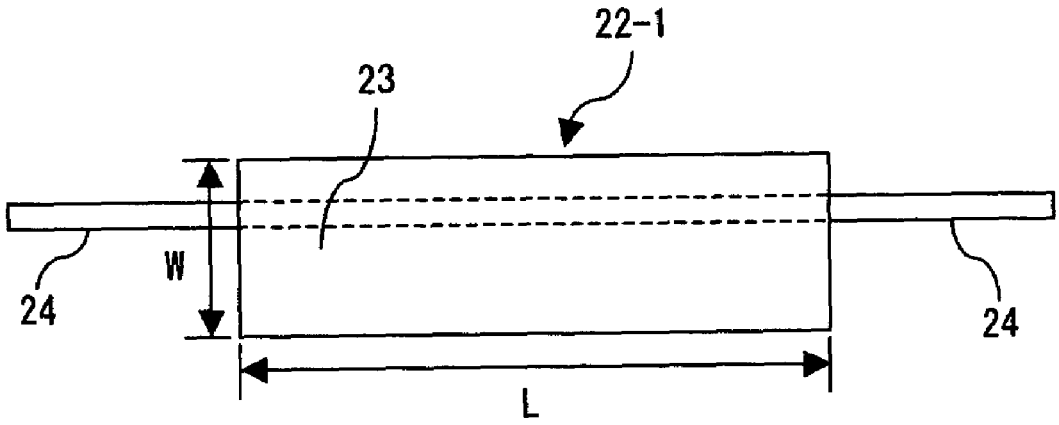
FIGS. 9A, 9B, 9C and 9D are the front view of a shielding material, and its side view, the front view of a conductive tape and the front view of a soft conductor wire, respectively.
Figure 9B:
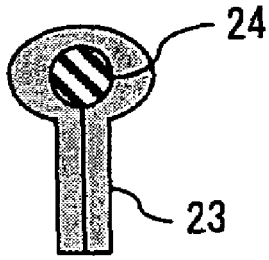
Figure 9C:
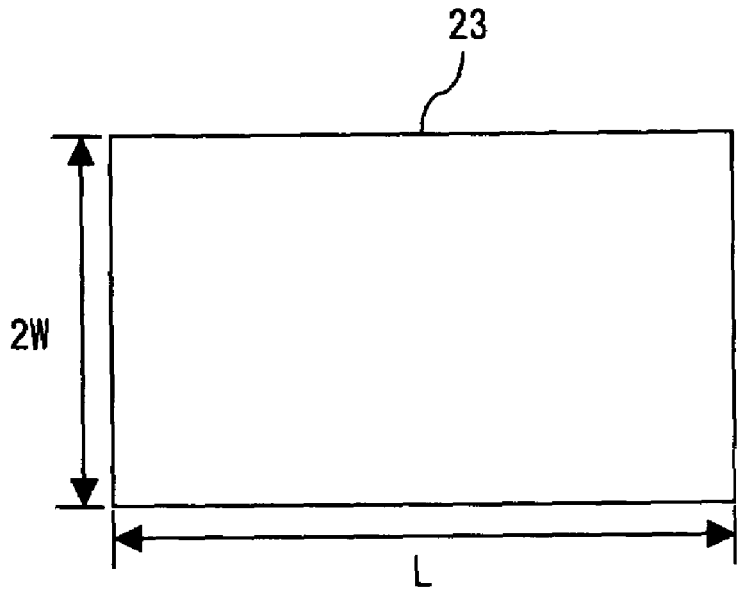
Figure 9D:
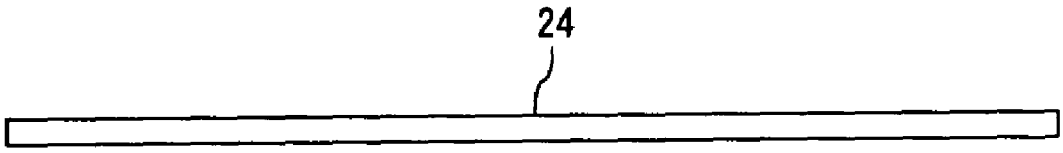

In FIGS. 9A & B, in the shielding material 22-1, the conductive tape 23 is folded into two, the soft conductor wire 24 is inserted inside the folded conductive tape 23 and its opposing sides are glued to each other. As shown in FIG. 9C, this conductive tape 23 has a rectangular shape of dimensions 2W×L and is made of metal foil, such as copper foil, aluminum foil, silver foil, gold foil or the like. The rear side of the conductive tape 23 is coated with adhesive, which can glue metal foil, which is not shown in FIG. 9C. However, as shown in FIG. 9D, for the soft conductor wire 24, a slender flexible soft copper wire or the like, whose surface is metal-plated with tin, silver or the like, is used. The length of the soft conductor wire 24 is at least longer than the longitudinal length (L) of the conductive tape 23, and a prescribed length is extended from each end. This is because a sufficient extra length is needed in order to easily solder the soft conductor wire 24 to the common electrode 20 of the substrate 17.

Then, as shown in FIG. 8, the folded in half conductive tape (W×L) 23 is disposed to cover the dielectrics 12 and 12' of each of two coaxial cables 10 from the reverse side of the substrate 17. In this state, each free end of the soft conductor wires 24 extended from each end of the conductive tape 23 is soldered (21) to each common electrode 20 of the substrate 17. As described above, the drain line 13 pulled out from each coaxial cable 10 is soldered (21) to each common electrode 20 of the substrate 17.

Although in the description of this preferred embodiment, the conductive tape 23 is folded into two, and the soft conductor wire 24 is inserted inside the folded conductive tape 23 and its opposing tapes are glued to each other, the present invention is not limited as such. For example, one conductive tape 23 of a desired size (W×L) can also be used from the beginning, and each soft conductor wire 24 can also be directly soldered to each side of the conductive tape 23. Although in FIG. 8, the length (W') of the exposed part of the dielectrics 12 and 12' of the coaxial cable 10 is shorter than the vertical length (W) of the folded in half conductive tape 23 of the shielding material 22-1 (see FIG. 9A), this is only for the sake of convenience.

Specifically, it is preferable that the length (W') of the exposed part of the dielectrics 12 and 12' and the vertical length (W) of the folded in half conductive tape 23 should be almost equal. It is preferable that the longitudinal length (L) of the conductive tape 23 should be longer than the length (L') in the array direction of the exposed dielectrics 12 and 12' of each coaxial cable 10 (see FIG. 9A). This is because the shielding effect of the dielectrics 12 and 12' can be improved by being certain of covering the dielectrics 12 and 12' by the conductive tape 23. The longitudinal length (L) of the conductive tape 23 can be increased or decreased as required, according to the number of arrayed coaxial cables.

Furthermore, in this preferred embodiment, it is assumed that the melting temperature of the dielectrics 12 and 12' is lower than a soldering temperature. If the melting temperature of the dielectrics 12 and 12' is higher than a soldering temperature, the conductive tape 23 covered by the dielectrics 12 and 12' can also be directly soldered to the common electrode 20 in the vicinity of the dielectrics 12 and 12'.

According to this preferred embodiment, since each of the exposed dielectrics 12 and 12' is covered with the shielding material 22-1 at the respective ends of two coaxial cables 10, the shielding effect at the end can be improved by this shielding material 22-1, and the impedance of the part can be reduced. The fluctuations of the impedance in a coaxial cable can be reduced and the impedances can be matched.

(The Second Preferred Embodiment)

Figure 10:
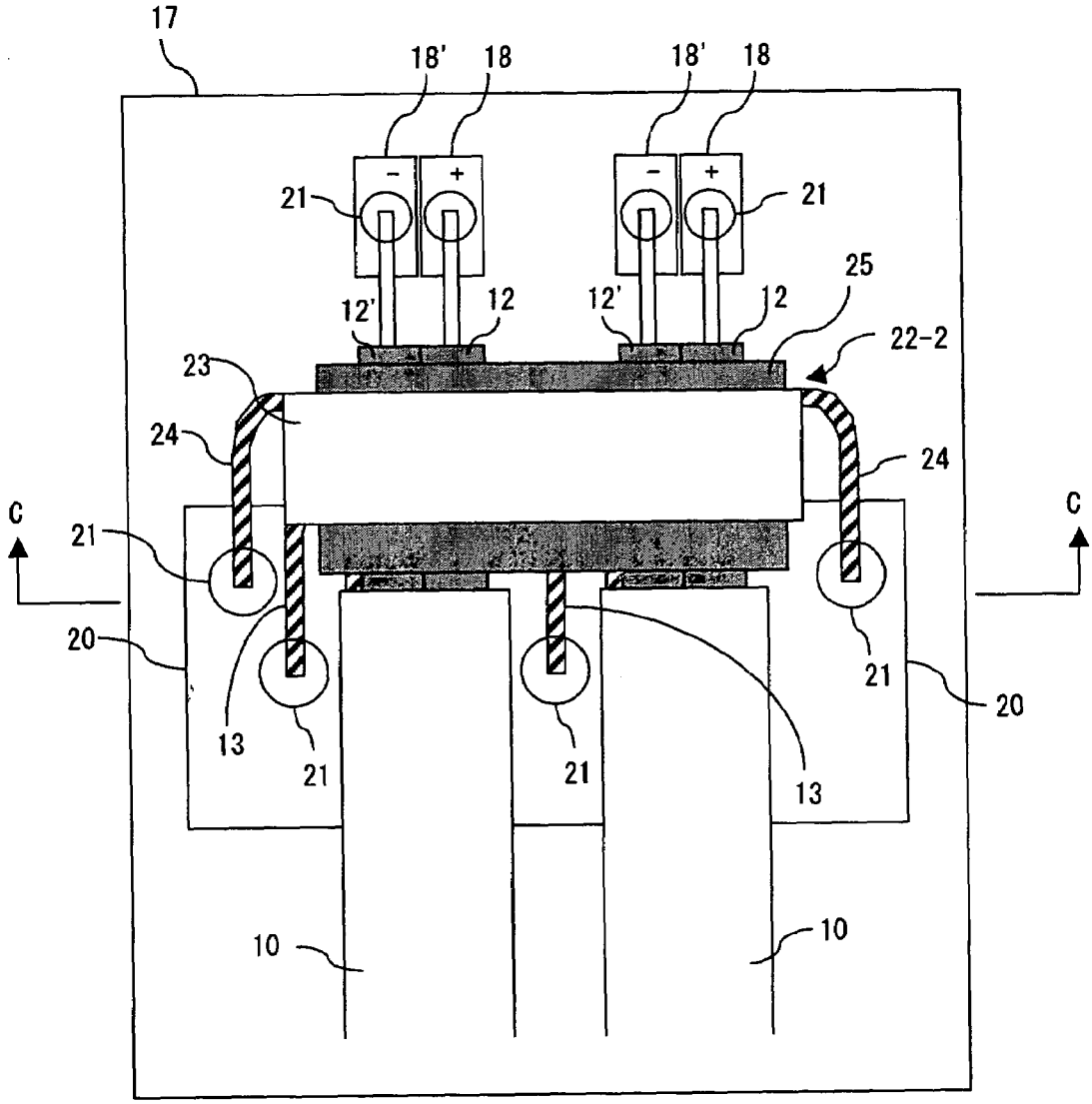
FIG. 10 shows the structure of the end of the coaxial cable of the second preferred embodiment.

FIG. 10 shows the end structure of the coaxial cable 10 of the second preferred embodiment.

Figure 11:
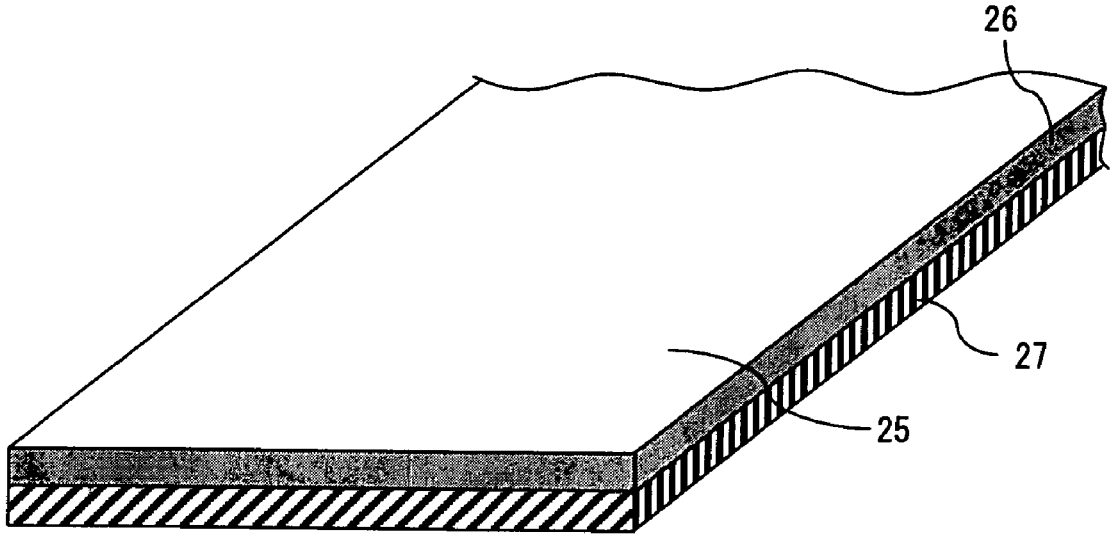
FIG. 11 shows the appearance of a conductive sheet.

In this preferred embodiment, a shielding material 22-2 comprises a conductive sheet 25 as a second conductor foil in addition to the conductive tape 23 and soft conductor wire 24 of the first preferred embodiment. As shown in FIG. 11, this conductive sheet 25 comprises a conductor part (metal part) 26. Adhesive 27 is coated on the rear side, and an adhesive which can glue the dielectric 12 is used. For the conductive sheet 25, the above-described conductive tape 23 can also be used. Specifically, a soft conductor wire can also be extended from each end side of the conductive sheet 2, which is not shown in FIG. 10. In this case, the soft conductor wire is also soldered to the common electrode 20.

In FIG. 10, in order to use this shielding material 22-2, firstly, the exposed dielectrics 12 and 12' are collectively covered with the conductive sheet 25 on the reverse side of the substrate 17. In this case, the dielectrics 12 and 12' of each coaxial cable 10 and the drain line 13 are covered and glued to the surface of the conductive sheet 25, on which the adhesive 27 is coated.

Figure 12:
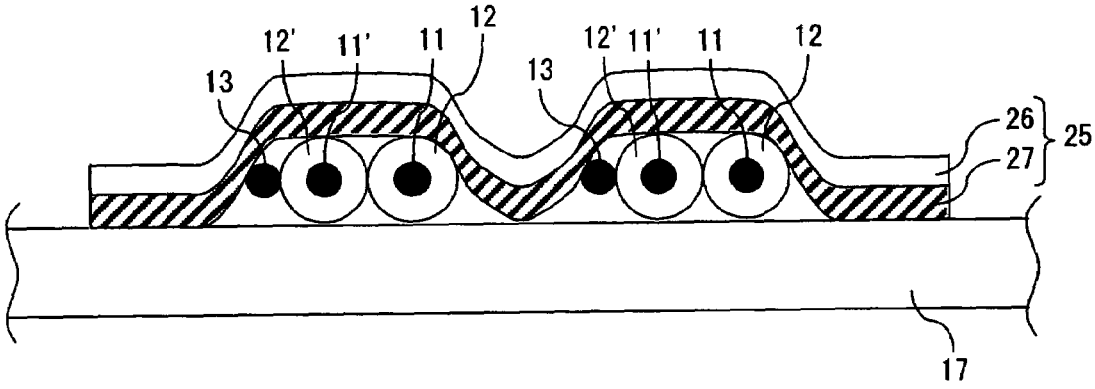
FIG. 12 is the C—C section view of FIG. 10.

In this case, it is preferable to embrace the dielectrics 12 and 12' in such a way as to increase the contact area between the conductive sheet 25 and the dielectrics 12 and 12' when gluing the conductive sheet 25. This is because the impedance of this part is made as low as possible by improving the shielding effect of the dielectrics 12 and 12'. Specifically, for example, as shown in FIG. 12, the conductive sheet 25is bent and disposed in such a way as to embrace the circumference of the dielectric 12 of each of the two adjacently arrayed coaxial cables 10. Because it is essentially ideal to cover and shield the entirety of each of the dielectrics 12 and 12' with the conductive sheet 25.

Then, the shielding material 22-1 (conductive tape 23 and soft conductor 24) is disposed in such a way as to cover this conductive sheet 25 from its front side (top side), as described in the first preferred embodiment. In this case, it is preferable that the conductive tape 23 and the conductive sheet 25 are closed. This is because the shielding effect is improved by reducing the electric resistance between the conductive tape 23 and conductive sheet 25. Furthermore, the free end of each soft conductor wire 24, extended from the conductive tape 23 is soldered (21) on each common electrode 20 of the substrate 17. The drain line 13 pulled out from each coaxial cable 10 is soldered (21) to each common electrode 20 of the substrate 17.

According to this preferred embodiment, since the circumference of each of the dielectrics 12 and 12' is covered by the conductive sheet 25 and the shielding material 22-1 as the shielding material 22-2, the shielding effect at the end can be further improved and its impedance can be further reduced.

(The Third Preferred Embodiment)

Figure 13:
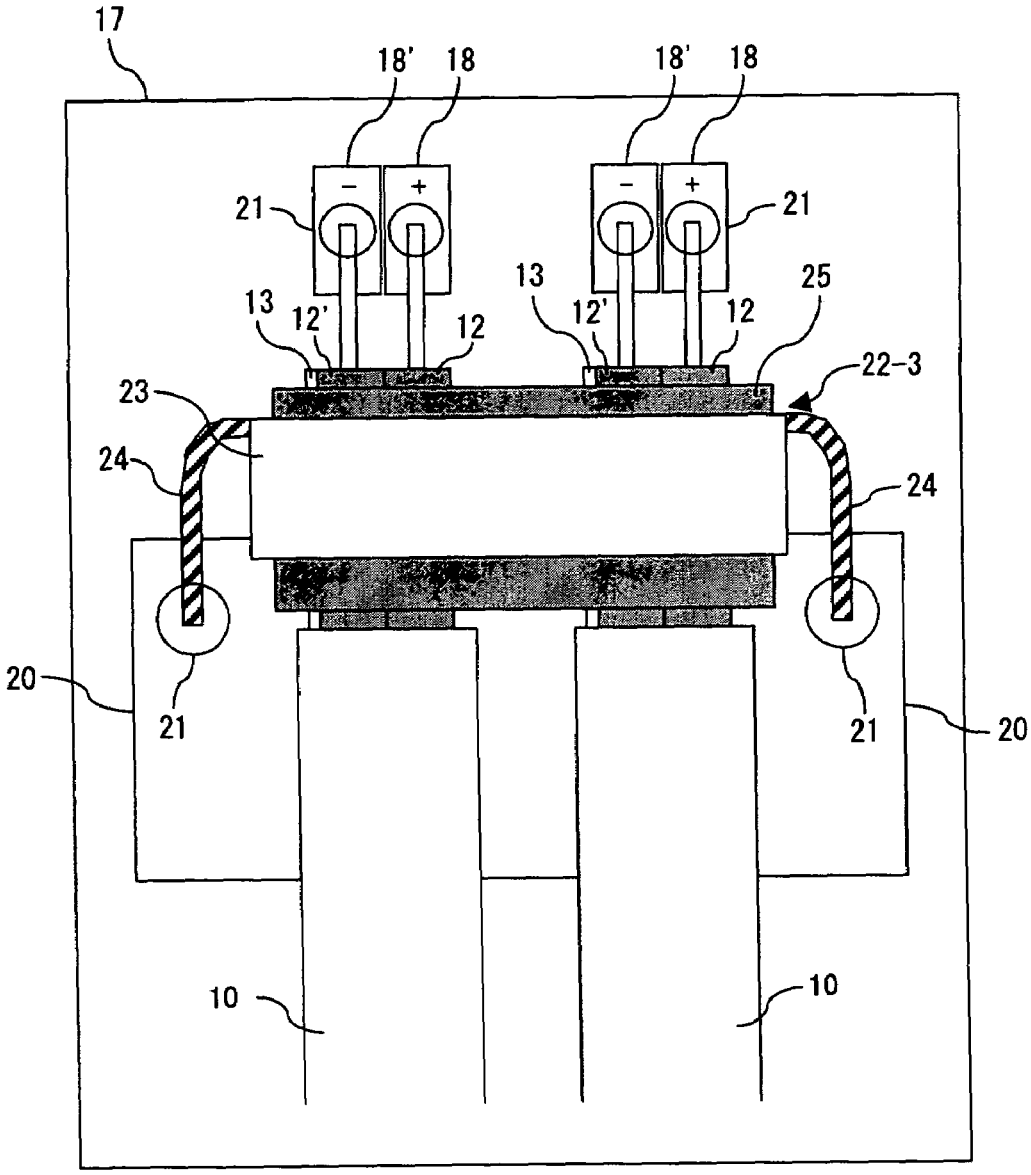
FIG. 13 shows the structure of the end of the coaxial cable of the third preferred embodiment.

FIG. 13 shows the end structure of the coaxial cable 10 of the third preferred embodiment.

In this preferred embodiment, a shielding material 22-3 comprises a conductive sheet 25 in addition to the conductive tape 23 and soft conductor wire 24 as in the second preferred embodiment. However, in this preferred embodiment, the drain lines 13 pulled out from each coaxial cable 10 are not soldered to each common electrode 20 of the substrate 17 as in the second preferred embodiment.

In FIG. 13, in order to use this shielding material 22-3, firstly, the exposed dielectrics 12 and 12' are covered with the conductive sheet 25 from the reverse side of the substrate 17. In this case, as in the second preferred embodiment, the dielectrics 12 and 12' of each coaxial cable 10 and the drain line 13 are collectively covered and glued to the surface of the conductive sheet 25, on which the adhesive 27 is coated. In this case too, as shown in FIG. 12, the conductive sheet 25 is bent and disposed in such a way as to embrace the circumference of the dielectric 12 of each of the two adjacently arrayed coaxial cables 10.

Then, the shielding material 22-1 (conductive tape 23 and soft conductor wire 24) is disposed in such a way as to cover this conductive sheet 25 from its front side as described in the first and second preferred embodiments.

Furthermore, the free end of each soft conductor wire 24, extended from the conductive tape 23 is soldered (21) to each common electrode 20 of the substrate 17.

However, in this preferred embodiment, the drain line 13 pulled out from each coaxial cable 10 is not soldered to each common electrode 20 of the substrate 17. Each drain line 13 is simply sandwiched between the conductive sheet 25 and the substrate 17. This is because the drain line 13 and the conductive sheet 25 covering the drain line 13 are connected with some resistance, and the drain line 13 is connected to the common electrode 20 via this conductive sheet 25.

According to this preferred embodiment, in a state where the shielding effect at the end of the coaxial cable 10 is improved, there is no need to solder the drain line 13 to the common electrode 20 of the substrate 17, and its impedance at the end can be reduced.

(The Fourth Preferred Embodiment)

Figure 14:
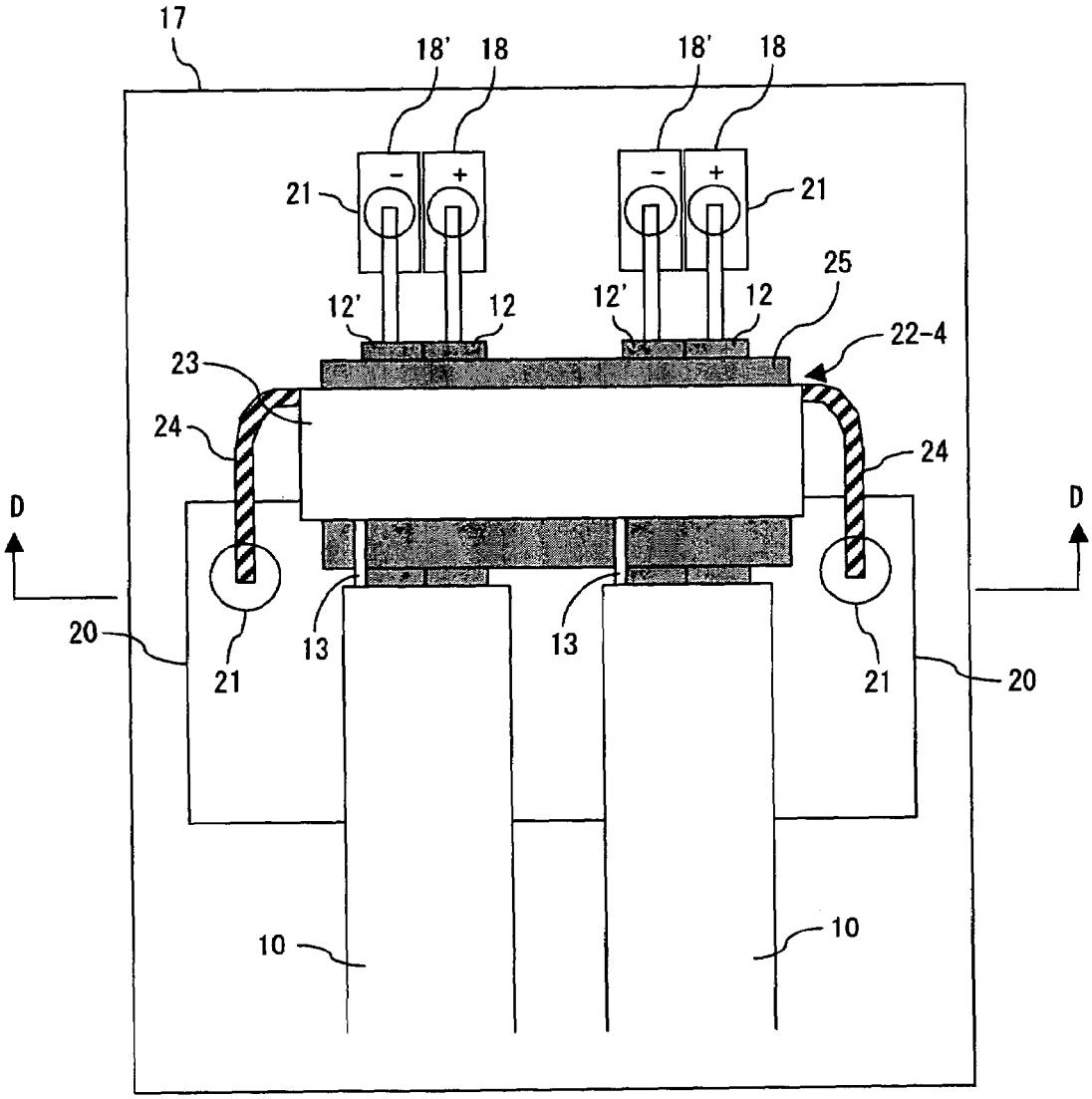
FIG. 14 shows the structure of the end of the coaxial cable of the fourth preferred embodiment.
Figure 15:
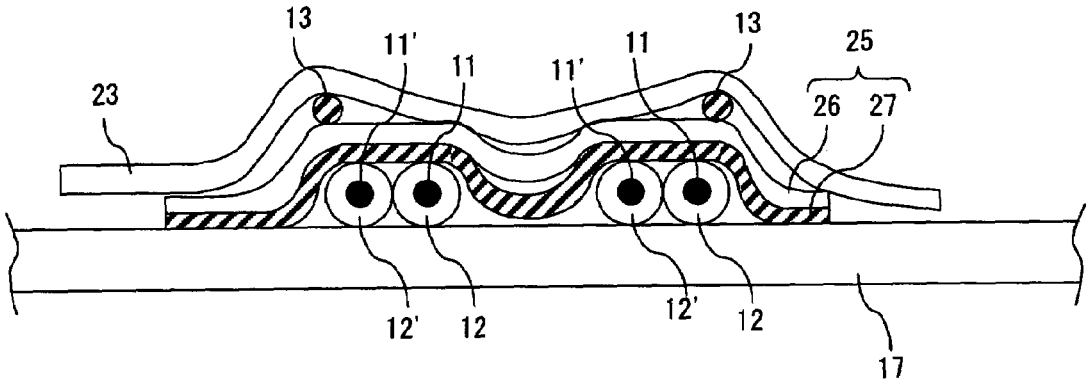
FIG. 15 is the D—D section view of FIG. 14.

FIGS. 14 and 15 show the end structure of the coaxial cable 10 of the fourth preferred embodiment.

In this preferred embodiment, a shielding material 22-4 comprises a conductive sheet 25 in addition to the conductive tape 23 and soft conductor wire 24 as in the second and third preferred embodiments. The drain line 13 pulled out from each coaxial cable 10 is not soldered to each common electrode 20 of the substrate 17. However, in this preferred embodiment, each drain line 13 is sandwiched between the conductive sheet 25 and the conductive tape 23 as not in the third preferred embodiment.

In FIG. 14, in order to use this shielding material 22-4, firstly, the exposed dielectrics 12 and 12' are covered by the conductive sheet 25 from the reverse side of the substrate 17. In this case, the dielectrics 12 and 12' of each coaxial cable 10 are collectively covered and glued by the surface of the conductive sheet 25, on which the adhesive 27 is coated. In this case too, as shown in FIG. 12, the conductive sheet 25 is bent and disposed in such a way as to embrace the circumference of the dielectric 12 of each of the two adjacently arrayed coaxial cables 10.

Then, as shown in FIG. 15, two drain lines 13 pulled out from each coaxial cable 10 are extended in the longitudinal direction and are arrayed. Furthermore, the shielding material 22-1 (conductive tape 23 and soft conductor wire 24) are disposed in such a way as to cover this conductive sheet 25 and the drain line 13 from its front side as described in the first through third preferred embodiments. Furthermore, the free end of each soft conductor wire 24, extended from the conductive tape 23 is soldered (21) to each common electrode 20 of the substrate 17.

In this case, since the drain line 13 is not sandwiched, the contact area between the dielectrics 12 and 12' and the conductive sheet 25 becomes much larger than in the third preferred embodiment. Therefore, the shielding effect of this part can be further improved. In this preferred embodiment, as in the third preferred embodiment, the drain line 13 pulled out from each coaxial cable 10 is not soldered to the common electrode 20 of the substrate 17 but is simply sandwiched between the conductive sheet 25 and the conductive tape 23. However, in this case, since the drain line 13 is sandwiched between the conductive sheet 25 and the conductive tape 23, the drain line 13 is connected to the common electrode 20 via this conductive sheet 25 and the conductive tape 23.

According to this preferred embodiment, in a state where the shielding effect at the end of the coaxial cable 10 is improved, there is no need to solder the drain line 13 to the common electrode 20 of the substrate 17, and its impedance at the end can be reduced.

(The Fifth Preferred Embodiment)

Figure 16:
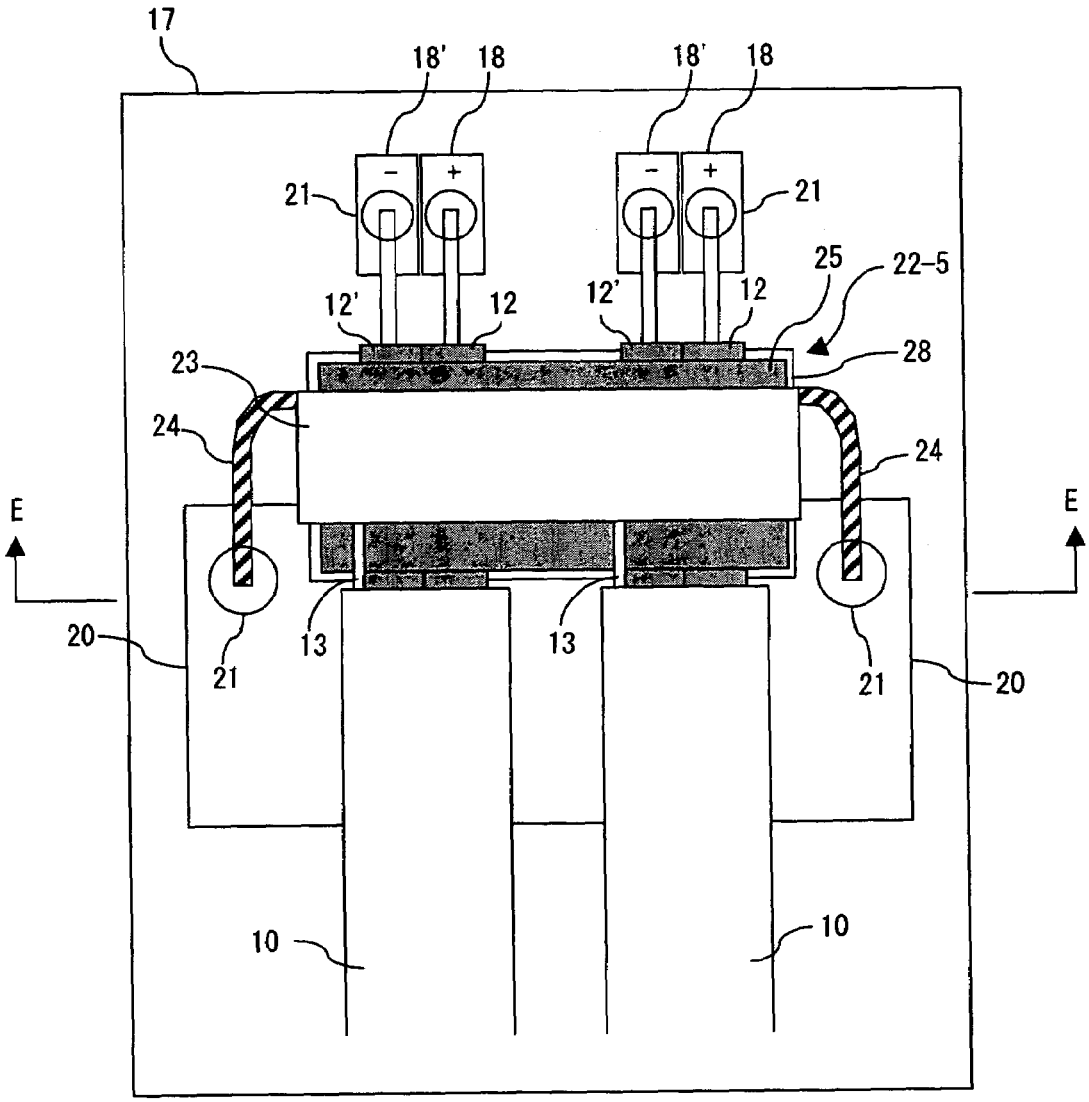
FIG. 16 shows the structure of the end of the coaxial cable of the fifth preferred embodiment.
Figure 17:
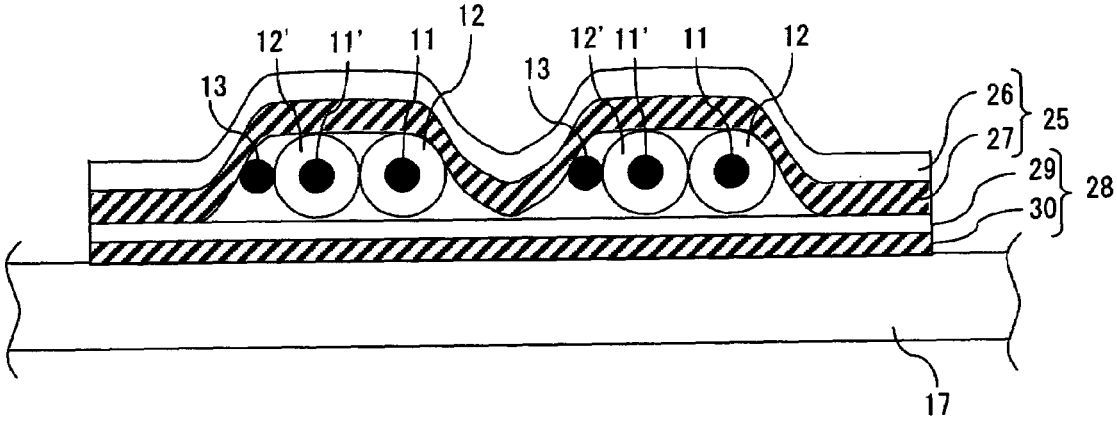
FIG. 17 is the E—E section view of FIG. 16.

FIGS. 16 and 17 show the end structure of the coaxial cable 10 of the fifth preferred embodiment.

In this preferred embodiment, a shielding material 22-5 comprises a conductive sheet 25 and a conductor sheet 28 as a third conductor foil in addition to the conductive tape 23 and soft conductor wire 24. As shown in FIG. 17, this conductor sheet 28 comprises a conductor part (metal part) 29, on the rear side of which adhesive 30 is coated. For this conductor sheet 28, the above-described can also be used. Alternatively, a soft conductor wire can also be extended from each end of the conductor sheet 28. In this case, the soft conductor wire is also soldered to the common electrode 20.

Then, in order to use this shielding material 22-5, before soldering each coaxial cable 10 to the substrate 17, a first conductive sheet 28 is glued to one front surface of the substrate 17 on which the coaxial cables are arrayed in advance. Then, each coaxial cable 10 is laid almost parallel to one front surface of the substrate 17 over this conductive sheet 28. Furthermore, the exposed dielectrics 12 and 12' of this coaxial cable 10 are covered with a second conductive sheet 25 on the reverse side of the substrate 17.

Then, the shielding material 22-1 (conductive tape 23 and soft conductor wire 24) is disposed in such a way as to cover the conductive sheet 25 as described in the first through fourth preferred embodiments. Furthermore, the free end of each soft conductor wire 24, extended from the conductive tape 23 is soldered (21) to each common electrode of the substrate 17. In this preferred embodiment, each drain line 13 pulled out from each coaxial cable 10 may or may not be soldered to the common electrode of the substrate 17. Furthermore, this drain line 13 may be sandwiched between the first conductive sheet 28 and the second conductive sheet 25 or between the second conductive sheet 25 and the conductive tape 23.

What is claimed is:

1. A structure of a coaxial cable in which the housing and conductor layer of an end of the coaxial cable comprising a dielectric covering, a core wire, a conductor layer disposed around the dielectric and a housing disposed around the conductor layer are removed, a prescribed length of an exposed part of the dielectric is removed from an end of the core wire, and the core wire is exposed, wherein a flexible shielding material is disposed in such a way as to cover a remaining part of the exposed dielectric, and the shielding material is grounded.

2. The structure of a coaxial cable according to claim 1, wherein the shielding material comprises:

a first conductor foil for covering the dielectric; and a conductor wire extending from the first conductor foil.

3. The structure of a coaxial cable according to claim 1, wherein a ground line pulled out from between the dielectric and the conductor layer is grounded.

4. The structure of a coaxial cable according to claim 1, wherein a ground line pulled out from between the dielectric and the conductor layer is connected to the shielding material.

5. The structure of a coaxial cable according to claim 1, wherein

The shielding material comprises a first conductor foil for covering the dielectric;

a conductor wire extended from the first conductor foil; and a second conductor foil disposed between the first conductor foil and the dielectric.

6. The structure of a coaxial cable according to claim 1, wherein

The shielding material comprises a first conductor foil for covering the dielectric;

a conductor wire extended from the first conductor foil;

a second conductor foil disposed between the first conductor foil and the dielectric; and a third conductor foil disposed on a side the reverse of the second conductor foil against the dielectric electrically connected to the second conductor foil.

7. The structure of a coaxial cable according to claim 1, wherein the dielectric has a melting temperature lower than a soldering temperature.

8. An electronic device comprising:

a substrate containing a connecting portion and a grounding portion; and a cable, the cable comprising:

a core wire connected to said connecting portion;

a dielectric portion enclosing said core wire;

a conductor layer disposed around said dielectric portion; and a flexible shielding portion covering a portion of said dielectric portion where not covered by said conductor layer, and connected to said grounding portion.

9. The electronic device according to claim 8, wherein said shielding portion comprising:

a first conductive film; and a conductive line extending from said first conductive film, and connected to said grounding portion.

10. The electronic device according to claim 9, wherein said shielding portion further comprising:

a second conductive film covering said dielectric portion; wherein said first conductive film is disposed to cover said second conductive film.

11. The electronic device according to claim 10, wherein said second conductive film comprising adhesive layer on one side.

12. The electronic device according to claim 11, wherein:

said cable further comprising a ground line, wherein said ground line is disposed between said first conductive film and said second conductive film.

* * * * *